US005730076A

United States Patent [19]

Ruebel et al.

[11] Patent Number: 5,730,076

[45] Date of Patent: Mar. 24, 1998

[54] ADJUSTING DEVICE FOR A FOLDING RAIL ON A SEWING MACHINE

[75] Inventors: Andreas Ruebel, Olsbruecken; Eduard Bastian, Kaiserslautern, both of Germany

[73] Assignee: G.M. Pfaff Aktiengesellschaft, Kaiserslautern, Germany

[21] Appl. No.: 703,999

[22] Filed: Aug. 28, 1996

[30] Foreign Application Priority Data

Sep. 5, 1995 [DE] Germany ..... 29514185 U

[51] Int. Cl.[6] ..... D05B 21/00; D05B 35/00

[52] U.S. Cl. ..... 112/470.16; 112/147

[58] Field of Search ..... 112/144, 147, 112/470.14, 470.16, 470.18; 74/526, 569, 838, 591; 192/116.5; 188/72.8, 72.9

[56] References Cited

U.S. PATENT DOCUMENTS

| | | | |
|---|---|---|---|
| 3,522,783 | 8/1970 | Pollmeier . | |
| 4,098,208 | 7/1978 | Hedegaard | 112/291 |
| 4,549,491 | 10/1985 | Albrecht et al. | 112/315 X |
| 4,589,363 | 5/1986 | Willenbacher et al. | 112/315 X |

FOREIGN PATENT DOCUMENTS

| | | |
|---|---|---|
| 1 660 839 | 5/1971 | Germany . |
| 80 27 080 | 1/1981 | Germany . |

*Primary Examiner*—Paul C. Lewis
*Attorney, Agent, or Firm*—McGlew and Tuttle

[57] ABSTRACT

A device for adjusting a fold depth of a folding rail is provided for use on a sewing machine. The device includes a rotatable stop disk with an adjusting cam providing a continuously extending surface. An actuator is provided for driving the stop disk. The actuator is preferably a stepping motor and the adjusting cam preferably has a spiral shape.

15 Claims, 1 Drawing Sheet

ADJUSTING DEVICE FOR A FOLDING RAIL ON A SEWING MACHINE

FIELD OF THE INVENTION

The present invention pertains to a device for adjusting a fold depth of a folding rail used on a sewing machine with a rotatable stop disk.

BACKGROUND OF THE INVENTION

Two multistep stop disks, which are manually adjustable independently from one another, are used in a device known from DE 80 27 080 U1 for preparing tucks on cut parts of pieces of clothing with a folding rail adjustable within a range limited by stops. One of the stop disks is arranged on a pivotable bracket, which can be moved by means of a compressed air cylinder into two different pivoted positions, one of which is stationary and the other can be adjusted by the setting position of the other, stationarily mounted stop disk. The folding rail is in spring-loaded contact with the stop disk arranged on the bracket and is carried in a corresponding manner during the pivoting of the bracket to the other stop disk. The folding rail can thus be moved to and from for alternatingly sewing tucks of different depth between two adjustable fold depths.

Aside from the fact that the stop disks, designed as multistep disks, permit only a limited number of adjustment possibilities, the prior-art device also has the additional drawback that the second fold depth that can be obtained by pivoting the bracket to the stationarily mounted second stop disk depends on the setting position of both stop disks, because their action adds up in this case. If, e.g., the first fold depth is to be changed, whereas the second fold depth shall remain unchanged, the setting position of the second stop disk must also be changed after the setting of the first stop disk mounted on the bracket, and the setting position of the second stop disk must be changed by the same amount, but with the opposite sign.

SUMMARY AND OBJECTS OF THE INVENTION

The primary object of the present invention is to provide an adjusting device for a folding rail, by means of which any desired fold depth can be obtained in a simple manner within a predetermined setting range.

According to the invention, a device is provided for adjusting a fold depth of a folding rail used on a sewing machine. A rotatable stop disk is used. The stop disk has a continuously extending adjusting cam that is connected to an actuator. The actuator can be controlled in a sensitive manner to provide a high degree of adjustment.

By correspondingly energizing the actuator, which operates at least in a sensitive manner, the folding rail, which is elastically supported on the stop disk directly or indirectly, can be set very accurately to the desired fold depth by the continuously extending adjusting cam of the stop disk.

This is of particular importance for preparing, e.g., pleated skirts, because even slight dimensional deviations from the desired fold depth would add up to a no longer acceptable deviation from the standard size because of the large number of folds to be formed.

When tucks extending at an acute angle are prepared by means of special folding rails, which define the shape and depth of the tuck, the deviation of the actual intersection of the seam line with the fabric fold line from the desired intersection, which deviation is due to a change from a thin fabric to a thick one or vice versa, from a thick fabric to a thin one, can be corrected by means of the adjusting device according to the present invention in a sensitive manner, as a result of which it is guaranteed that the end stitches of the seam, which are intended to secure the seam and are shortened according to the program, are always formed at the desired distance from the folded edge of the fabric.

The adjusting cam preferably has a spiral shape. The actuator may preferably be provided as a stepping motor.

Any desired setting values can be programmed in any desired order in a simple manner by operating a stepping motor by means of a program control for obtaining predeterminable setting values which can be set in any desired order, and they can be polled during sewing either by switching commands of the operator or as an automatic process.

The setting position of the stop disk is nonpositively locked during each movement of the folding bar into its transfer position by means of the locking device based on the stop disk being arranged in a bracket formed by at least two plates and containing a brake disk, which is connected to it to rotate with it in unison and projects over a largest radius of the adjusting cam and the actuator, which can be brought into functional connection with the brake disk via a pressure piece and is fastened to the bracket. The locking device consists of a brake disk and an actuator, which may be, e.g., a short-stroke cylinder, so that the stepping motor does not need to apply any holding force. Due to the stop disk being supported on a sleeve mounted in the bracket, radially directed impact forces occurring as a consequence of the rapid displacement of the folding rail are absorbed by the sleeve and are kept away from the motor shaft due to the carrier connection between the motor shaft and the stop disk being designed with a clearance.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
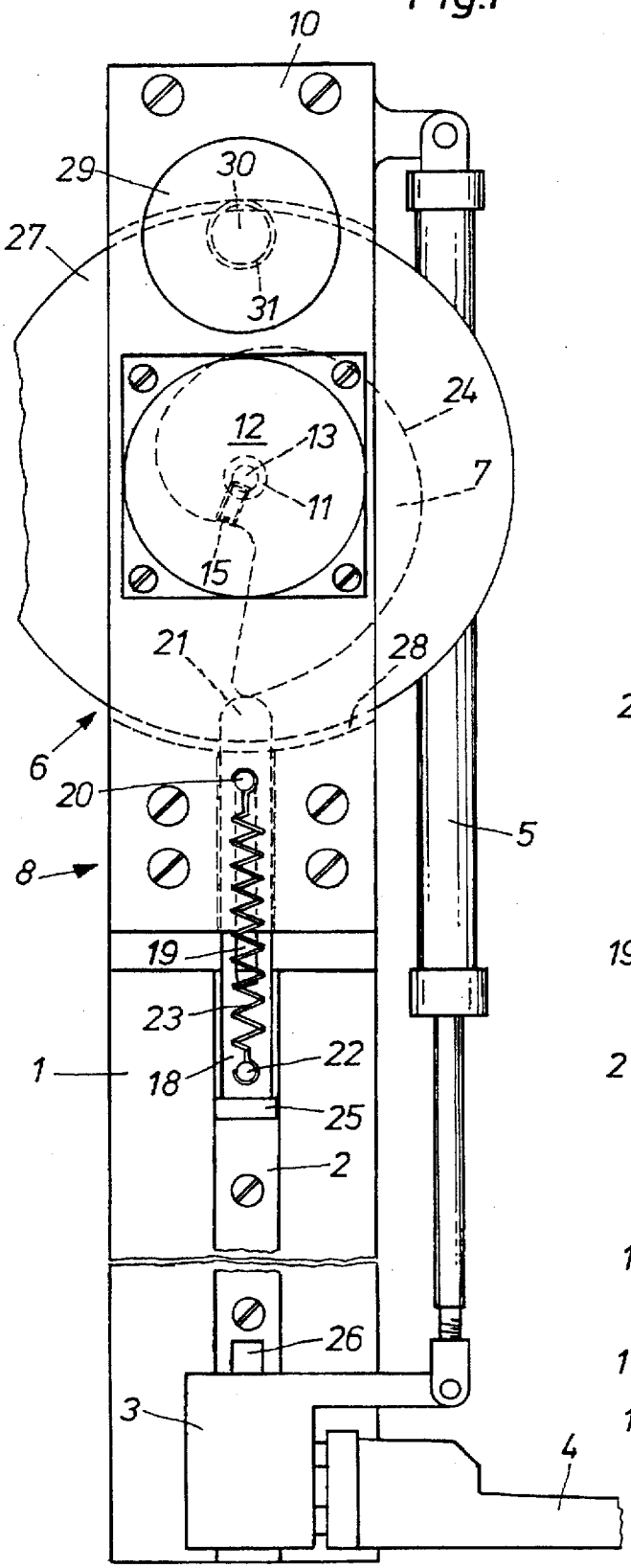
FIG. 1 is a top view of the adjusting device.
Figure 2:
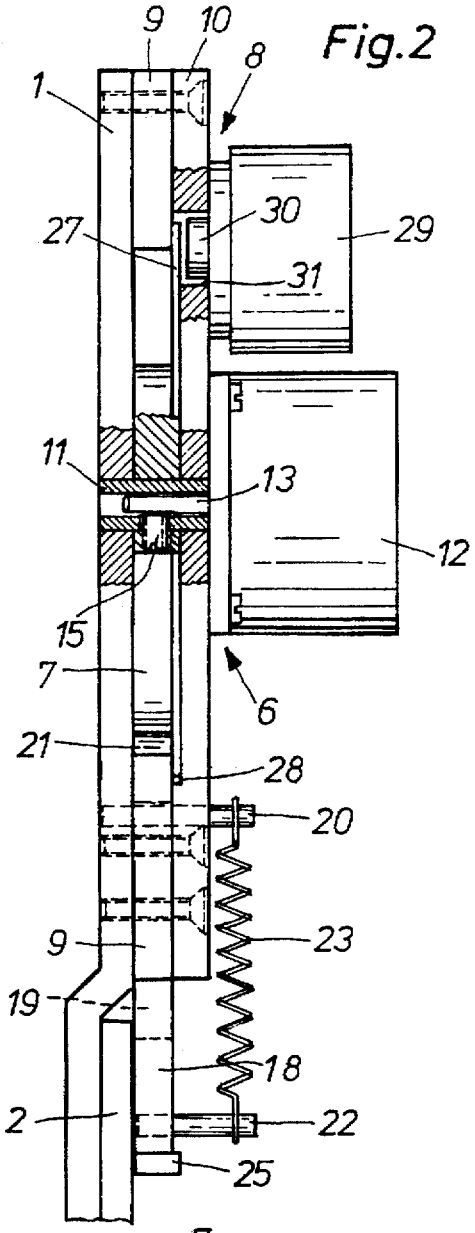
FIG. 2 is a partially cutaway side view.

Referring to the drawings in particular, the invention comprises a guide rail 2 for a carriage 3 that can be moved along on the said guide rail is fastened to a support plate 1. A folding rail 4 comparable to the folding rail disclosed in DE 80 27 080 U1 is detachably fastened to the carriage 3. Like the prior-art folding rail, the folding rail 4 is adjustable in a manner not specifically explained here and is also interchangeable with other folding rails having a different shape and different dimensions.

Together with the folding rail 4, the carriage 3 can be moved to and from by means of a compressed air cylinder 5 between an inserting position shown in the drawing and a working position, in which the folding rail 4 places the fabric to be provided with a fold in the correct position for sewing under a feed rail, not shown. The desired tuck depth of the fold or of a tuck which are to be formed depends on the shape and width of the folding rail 4 and is additionally determined by the adjusting device 6 according to the present invention.

Figure 3:
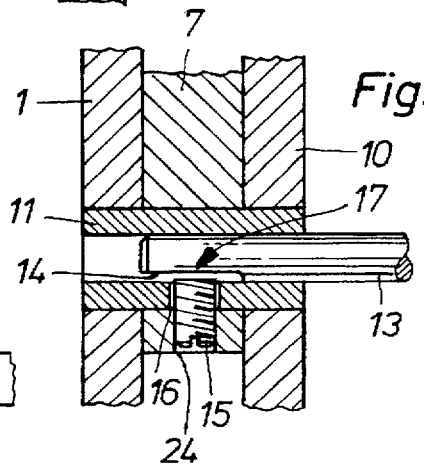
FIG. 3 is an enlarged detailed view taken from FIG. 2.

The adjusting device 6 contains a stop disk 7 of helical design, which is rotatably mounted in a bracket 8. The bracket 8 comprises the support plate 1 and a cover plate 10, which is arranged at a distance from the said support plate due to the intercalation of two distance plates 9. The stop disk 7 is arranged on a sleeve 11 mounted rotatably in the plates 1 and 10. A stepping motor 12 fastened to the cover plate 10 is used to drive the stop disk 7. The shaft 13 of the stepping motor 12 is arranged in a rotatably movable manner in the sleeve 11 and has a flattened area 14 (FIG. 3). A screw 15, which passes through a hole 16 contained in the sleeve 11 and ends at a short distance from the flattened area 14, is arranged in the stop disk 7. The screwed-in depth of the screw 15 is secured by bonding the screw 15 in its threaded hole. The flattened area 14 and the screw 15 form a carrier connection 17 between the shaft 13 and the stop disk 7, which carrier connection has a clearance.

A rod 18 is mounted displaceably in the longitudinal direction in the bracket 8. The rod 18 contains an elongated hole 19, which extends in parallel to the longitudinal axis of rod 18 and through which extends a pin 20 firmly arranged in the bracket 8. The rod 18 is designed with a rounded scanning head 21 at its end facing the stop disk 7. A tension spring 23, which is attached at one end to the pin 20 and at the other end to a pin 22 located in the rod 18, causes the rod 18 with its scanning head 21 to be maintained in continuous contact with the circumferential side of the stop disk 7, which circumferential side is called an adjusting cam 24.

At its end located opposite the scanning head 21, the rod 18 carries a stop plate 25. The stop plate 25 cooperates with a rod 26 of a hydraulically operating shock absorber, which is installed in the carriage 3. The shock absorber itself is of a known design, so that it is not explained more specifically.

The stop disk 7 is connected to a brake disk 27 of round design, with which it rotates in unison, and which projects beyond the greatest radius of the stop disk 7 or its adjusting cam 24. The brake disk 27 is accommodated in a flat opening 28 of the cover plate 10, whose dimensions are selected to be such that the stop disk 7 can be rotated unhindered with the brake disk 27. A short-stroke compressed air cylinder 29, whose piston rod 30, acting as a pressure piece, extends into a hole 31 in the cover plate 10, is fastened to the cover plate 10.

The short-stroke cylinder 29 is designed as a single-acting cylinder, whose piston rod 30 is moved into and held in the withdrawn position by a restoring spring. With the short-stroke cylinder 29 ventilated, the brake disk 27 is released, so that the stepping motor is able to rotate the stop disk 7 unhindered. When pressure is admitted to the short-stroke cylinder 29, the piston rod 30 presses the brake disk 27 against the distance plate 9 and thus causes the stop disk 7 to be locked in a frictionally engaged manner.

The stepping motor 12 can be operated by a prior-art, stored-program control equipped with a control panel. Due to the usually high step resolution of stepping motors per revolution, the stop disk 7 can be rotated in a highly sensitive manner, and a highly accurate angular adjustment can thus be performed.

The angular position of the stop disk 7 is adjusted or changed in the inserting position of the folding rail 4 shown in the drawing, in which the carriage 3, together with the rod 26 of the shock absorber, is moved away from the rod 18. Since the short-stroke cylinder 29 is ventilated in the process, the adjusting movements of the stepping motor 12 can be performed without applying an appreciable force.

The stop disk 7 is now adjusted such that the stepping motor 12 always reaches the desired setting position from a clockwise direction of rotation. If the adjustment is performed from a lower to a higher setting value, the stop disk 7 is turned by the stepping motor 12 directly to the new setting value. However, if a lower value shall be set from a higher setting value, the stepping motor 12 first rotates the stop disk 7 counterclockwise by three steps beyond the desired setting value and then turns it back clockwise by three steps, so that the new setting value is reached from a clockwise direction of rotation in this case as well. The clearance in the carrier connection 17 is thus compensated, so that exact setting values are always obtained in all cases.

Pressure is admitted simultaneously to the compressed air cylinder 5 and the short-stroke cylinder 29 to place the fabric in the correct position for sewing. Since the short-stroke cylinder 29 has a substantially shorter piston stroke than the compressed air cylinder 5, the brake disk 27 with the stop disk 7 is already secured against unintended rotation before the carriage 3 with the rod 26 reaches the stop plate 25 of the rod 18. The shock absorber provided in the carriage 3 damps the impact of the carriage 3 on the rod 18, so that excessive impact forces do not act on the stop disk 7, on the one hand, and the carriage 3 with the folding rail 4 does not rebound, on the other hand. Due to the stop disk 7 being mounted in the sleeve 11 and the carrier connection 17 between the shaft 13 and the stop disk 7 having a clearance, the impact forces acting on the stop disk 7 from the scanning head 21 of the rod 18 are kept away from the shaft 13 or are reduced to the extent that the stepping motor 12 will not be damaged.

After the fabric brought by the folding rail 4 into the sewing position has been taken over by the feed rail, the compressed air cylinder 5 is reversed, and the short-stroke cylinder 29 is ventilated. The setting position of the stop disk 7 is maintained by the holding torque of the stepping motor 12 alone for the time until the next withdrawing movement of the folding rail 4. Since this holding torque, on the one hand, and also the drive torque, on the other hand, may be relatively low for adjusting the stop disk 7, it is possible to use a relatively small and therefore inexpensive stepping motor.

Using the folding rail 4 inserted, a plurality of different fold depths can be set, as they are necessary or at least desired, e.g., in the case of the sewing of pleated skirts, by means of the stored-program control for the stepping motor 12, and the difference from the smallest to the largest fold depth depends on the difference between the smallest radius and the largest radius of the adjusting cam. Any desired order of different fold depths can be selected for performing defined sewing operations.

Highly accurate adjustment or correction of the intersection of the seam line with the fabric fold line can be performed during the sewing of tucks extending at an acute angle due to the possibility of an especially sensitive adjustment of the stepping motor 12, so that this intersection will always be located in the desired area in the case of thin and thick fabrics alike.

While a specific embodiment of the invention has been shown and described in detail to illustrate the application of the principles of the invention, it will be understood that the invention may be embodied otherwise without departing from such principles.

What is claimed is:

1. A device for setting the depth of fold on a sewing machine, comprising:

a folding rail;

a carriage guide for said folding rail, said carriage guide including a guide rail and a carriage;

a stop disk with a continuously extending adjusting cam;

an actuating drive connected to said stop disk for driving said stop disk, said actuating drive being controllable for fine step movements;

means for operatively connecting said adjusting cam to said carriage;

a displacing mechanism for displacing said carriage between a position adjacent to said stop disk and said means for connecting and a position remote from said stop disk and displaced from said means for connecting.

2. The device in accordance with claim 1, further comprising: a spring-loaded scanning member continuously in contact with said adjusting cam of said stop disk, arranged between said stop disk and said carriage.

3. The device in accordance with claim 1, from comprising: a brake mechanism, which can be switched on and off, said brake mechanism being associated with said stop disk for braking said stop disk.

4. The device in accordance with claim 3, further comprising a bracket, said stop disk being arranged in said bracket, said bracket being formed by at least two plates, said brake mechanism including a brake disk, which is connected to said stop disk and rotating in unison with said stop disk, said brake disk projecting beyond said stop disk in a radial direction, said brake mechanism including an actuator with a pressure piece which can be brought into functional connection with said brake disk.

5. The device according to claim 1, wherein said adjusting cam has a spiral shape.

6. The device according to claim 1, wherein said actuating drive is a stepping motor.

7. The device according to claim 6, further comprising a program control providing predeterminable stepping motor setting values which can be set in any desired order, said program control for operating said stepping motor.

8. A device according to claim 4, wherein said actuating drive is a stepping motor and further comprising a sleeve mounted rotatably in said bracket and a drive shaft connected to said stepping motor rotatably mounted in said sleeve, said stop disk being supported on said sleeve, said drive shaft being in drive connection with said stop disk via a carrier connection, said carrier connection defining a clearance.

9. A device according to claim 8, wherein said carrier connection comprises a flattened area on said shaft and a screw in said stop disk, said screw ending at a spaced location from said flattened area.

10. A device according to claim 1, wherein said displacing mechanism is a compressed air cylinder.

11. A device according to claim 3, wherein said brake mechanism includes a brake disk, an actuator, and a pressure piece.

12. A device for setting the depth of fold on a sewing machine, comprising:

a folding rail;

carriage guide means for guiding said folding rail, said carriage guide means including a guide rail and a carriage;

a stop disk with a continuously extending adjusting cam;

an actuating drive connected to said stop disk for driving said stop disk, said actuating drive being controllable for fine step movements;

means for operatively connecting said adjusting cam to said carriage;

a displacing mechanism for displacing said carriage between an adjusting position adjacent to said stop disk and connected to said cam via said means for connecting and a position remote from said stop disk and displaced from said means for connecting.

13. The device in accordance with claim 12, wherein said means for connecting includes a spring-loaded scanning member continuously in contact with said adjusting cam of said stop disk, arranged between said stop disk and said carriage.

14. The device in accordance with claim 12, further comprising: a brake mechanism, which can be switched on and off, said brake mechanism being associated with said stop disk for braking said stop disk.

15. The device in accordance with claim 14, further comprising a bracket, said stop disk being arranged in said bracket, said bracket being formed by at least two plates, said brake mechanism including a brake disk, which is connected to said stop disk and rotating in unison with said stop disk, said brake disk projecting beyond said stop disk in a radial direction, said brake mechanism including an actuator with a pressure piece which can be brought into functional connection with said brake disk.

* * * * *